US006109499A

United States Patent [19]

Garlaschi

[11] Patent Number: 6,109,499

[45] Date of Patent: Aug. 29, 2000

[54] DEVICE FOR MOVING WIRE ON MACHINE TOOLS

[75] Inventor: Eufemia Garlaschi, Milan, Italy

[73] Assignee: Carlo Salvi & C. S.r.l., Milan, Italy

[21] Appl. No.: 09/178,719

[22] Filed: Oct. 26, 1998

[30] Foreign Application Priority Data

Apr. 17, 1998 [IT] Italy ..... MI98A0823

[51] Int. Cl.[7] ..... B65H 20/18

[52] U.S. Cl. ..... 226/149

[58] Field of Search ..... 226/149; 83/153

[56] References Cited

U.S. PATENT DOCUMENTS 1,826,498 10/1931 Bignell ..... 226/149
2,128,964 9/1938 Pityo ..... 226/149
4,106,324 8/1978 Gotz ..... 226/149
4,552,294 11/1985 Rotzler ..... 226/149

*Primary Examiner*—John M. Jillions
*Attorney, Agent, or Firm*—Bucknam and Archer

[57] ABSTRACT

A device for moving wire on machine tools, especially applicable to forging machines employed for the production of bolts and screws, including a carriage (28) having an alternating axial motion for dragging wire to which a first mechanism (30) is associated for blocking said wire during the forwards motion of the carriage (28) and a second mechanism (52) for blocking and keeping said wire in place during the backwards movement of said carriage

6 Claims, 2 Drawing Sheets

DEVICE FOR MOVING WIRE ON MACHINE TOOLS

Figure 1:
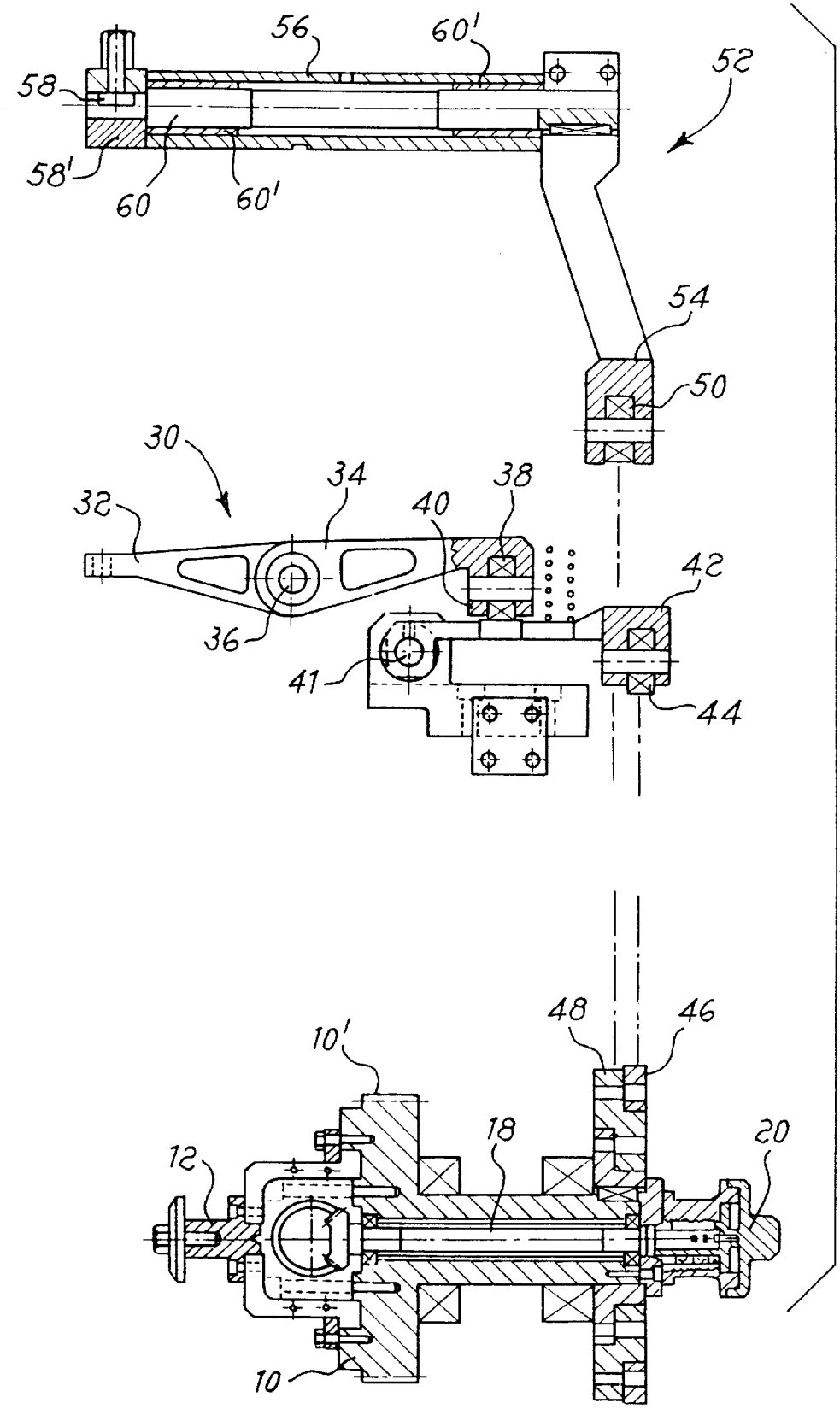

The present invention relates to a device for moving wire on machine tools.

In particular, the present invention relates to a device especially applicable in forging machines employed for the production of bolts and screws, suitable to move the wire from which screws, rivets and the like are obtained. Devices of this kind are commonly called "tension units", and they allow to drag the wire for a planned length according to the length of the screw, rivet or the like to be obtained. In the machine tools of the known art, the necessity of including a wire tension unit involves some severe drawbacks. It is in fact necessary to associate to each wire tension unit a wire stop ferrule, i.e. a further device suitable to block the wire in place, following its forward movement. As a consequence, besides the increase in the overall cost of the machine because of the added component, the tooling times become unavoidably longer; the adjustment of the wire length must in fact be carried out by qualified personnel. Besides, because of the presence of the wire stop ferrule, the room in the tool-holder space is markedly reduced, causing the operations of regulation or adjustment of other components such as matrix, punches, cutter and transport pliers, to become complex and difficult.

The object of this invention is to obviate the aforesaid drawbacks.

More particularly, the object of this invention is to realise a device for moving wire on machine tools, especially applicable to forging machines employed for the production of bolts and screws, wherein the wire tension unit allows a remarkable precision as concerns the length of the forward movement of said wire, excluding, consequently, the necessity of using a wire stop ferrule.

A further object of this invention is to realise a wire moving device that is particularly compact and such as not to reduce the room in the tool-holder space, causing therefore the operations of regulation of the adjoining components to be easy.

A further object of this invention is to realise a device as defined above which allows the quick and precise adjustment of the length of the shank of the item to be obtained, with no need for operations by qualified personnel.

A further object of the invention is to provide users with a device for moving wire such as to ensure a high level of resistance and reliability, and also such as to be easily and economically realised.

These and still other objects are achieved by the wire moving device of the present invention, especially applicable to tool machines employed for the production of bolts and screws, comprising a carriage having an alternating axial motion for dragging wire to which first means are associated for blocking said wire during the forwards motion of the carriage and second means for blocking and holding said wire in place during the backwards movement of said carriage.

Figure 2:
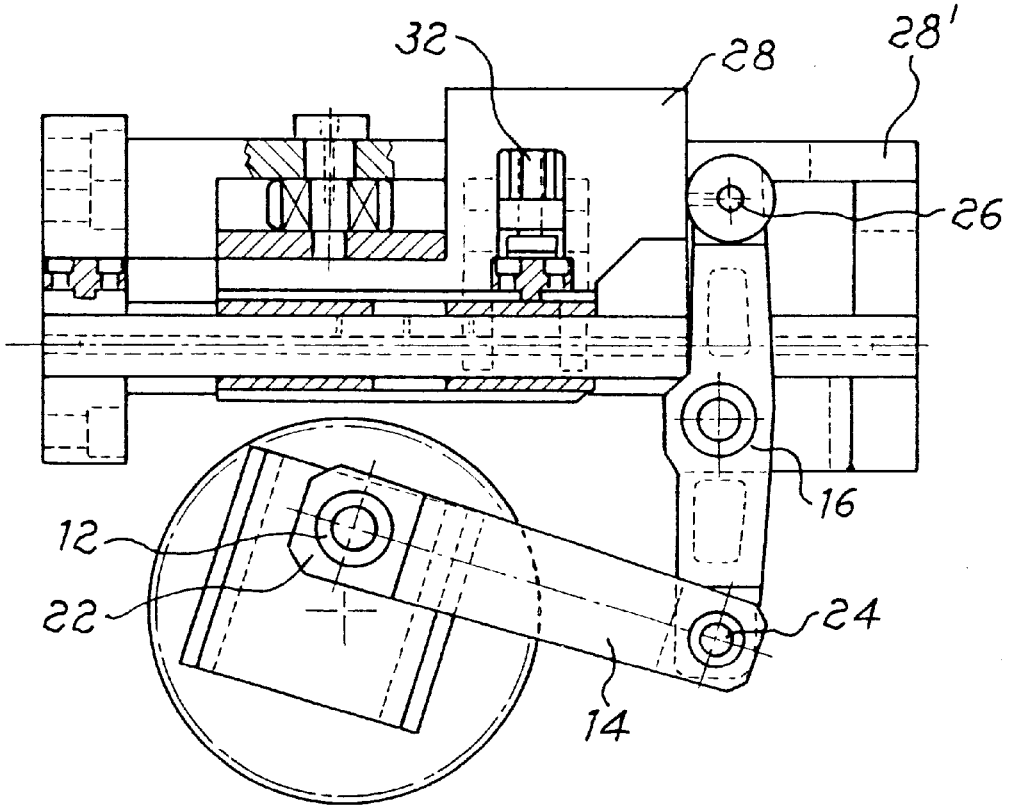
Figure 3:
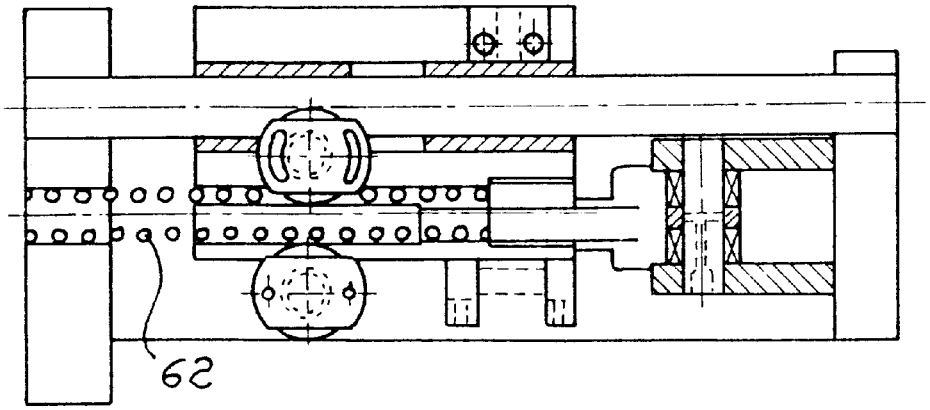

The construction and functional characteristics of the device for moving wire on machine tools of this invention will be better indicated by the following description, wherein reference is made to the attached drawings which represent a non-limiting preferred embodiment of the same, and wherein:

FIG. 1 schematically shows a side view of the device of this invention;

FIG. 2 schematically shows a front view of the same device, to stress the moving means controlled by an eccentric;

FIG. 3 schematically shows a further front view of the same device.

With reference to the figures, the device for wire moving of this invention is coupled to a rotation shaft 10 of the machine tool, preferably a forging machine for bolts and screws, and basically comprises an eccentric 12, a rod 14 and a lever 16.

Eccentric 12 is moved by shaft 10, to which it is connected by known means, and whose eccentricity is adjustable through a screw 18 longitudinally extended in said shaft from which it protrudes at one end to connect with an electric motor 20, preferably controlled by a programmable logic controller which may be set by means of a keyboard. Rod 14 is engaged at one end 22 with said eccentric, while it is connected at the opposite end, by means of a pin 24 or the like, to lever 16, whose orientation is substantially orthogonal with respect to the one of said rod 14.

The free end of lever 16, provided with conventional strike means constituted by one or more small rollers 26 or the like, is in touch with a carriage 28, sliding on special rails provided on the bearing casing, indicated by 28. The travel of carriage 28, which provides movement to the wire, is correlated to the position or regulation of eccentric 12 through said screw 18. On carriage 28 a pliers 30 is mounted, constituted by a front arm (32) and a back arm (34), articulated with one another through a fulcrum or pin (36); the back arm (34) is advantageously provided with a small roller (38) placed in a substantially orthogonal position with respect to said arms, which strikes a plane (40) defined by a lever (42). The latter, in its back part, is aligned and connected in an engagement relation through a rotary member 44, for instance a small roller, with a cam 46 borne by the rotation shaft 10, placed in a lower position. A second cam 48, suitable to strike roller 50 of an oscillating lever 52 above pliers 30, is positioned on the same shaft 10, next to cam 46.

The lever 52 is substantially L-shaped, comprising a vertical branch 54 and a horizontal branch 56, the latter overhanging carriage 28 which determines the forwards movement of the wire unwinding from a conventional coil or the like.

At the lower end of the vertical branch 54 of lever 52 a seat is provided to house said small roller 50, while at the front free end of the horizontal branch 56 of said lever a suitably shaped pressing member 58 is located, under which a fixed striker 58', integral with said lever, is provided. Lever 52 is borne by an oscillating pin 60, housed in fixed bushings 60', longitudinally extended in the horizontal branch 56, and said pressing member 58 is connected by known means to the front free end of said pin 60. Roller 50 of lever 52 is aligned to cam 48 of the underlying rotation shaft 10; the latter is provided with an integral crown with peripheral teeth 10' suitable to engage with a conventional gear of the forging machine, which transmits the rotary motion to said shaft.

Carriage 28, after the forwards motion caused by lever 16 connected to eccentric 12 though rod 14, automatically returns to the starting position by effect of a spring 62 or the like.

The working of the device for moving wire of the present invention is articulated into the following steps.

Eccentric 12, moved by shaft 10, causes the shifting of lever 16 which pushes forwards carriage 28 carrying the wire; the forwards movement of carriage 28 loads spring 62 associated to the same. At the same time, or directly before the forwards movement of carriage 28, cam 46 borne by shaft 10 strikes the rotary member or roller 44 of lever 42 and determines the lifting of plane 40 defined by said lever. The lifting of said plane 40 is followed by the lifting of the pressing member or pliers 30 through roller 38; as said pliers 30 is constituted by a front arm 32 and a back arm 34 articulated on fulcrum 36, the lifting of roller 38 leads the front arm 32 to lower on the wire to be dragged.

The moment when carriage 28 moves forward, also the wire is caused to move forwards by a length corresponding to the travel of said carriage, which may be previously adjusted through the positioning of the eccentric and the related screw 18.

The return to the starting position of carriage 28 having reached the end of its travel is ensured by spring 62, while lever 16, moved by eccentric 12, moves away from said carriage.

Before the return of carriage 28, cam 46 borne by the rotary shaft 10 causes roller 44 of lever 42 to lower, which results in lever 32 moving away from the previously compressed wire, releasing it. Now, it is necessary that the wire does not follow carriage 28 which is moving backwards; therefore, before the start of the step of returning of carriage 28, lever 52, activated by cam 48, also borne by the rotary shaft 10, intervenes. Cam 48, acting on roller 50 of lever 52, causes the oscillation of the same, so that its horizontal arm 56 and the related oscillating pin 60 bearing at the front end the pressing member 58 lowers on the wire, compressing it.

Therefore, in this stage, the wire is compressed and blocked between the pressing member 58 and the fixed striker 58'.

Carriage 28 can therefore move backwards freely, without there being the risk of a simultaneous backwards dragging of the wire which remains in the exact position where it had been previously led during the forwards motion and may therefore be subjected to the subsequent working step, namely cutting. The pressure exercised on the wire by the pressing member stops the moment when carriage 28 is caused to move forwards for a new feeding cycle and such step coincides with the return to the starting position of lever 52, determined by cam 48 which disengages from roller 50.

As can be understood from the above, the advantages achieved by the invention are obvious.

The device for moving wire of the present invention allows to obtain the precise forwards movement or wire measure, adjustable through eccentric 12 which determines the travel of carriage 28 and the precise keeping in place of the same wire thanks to the intervention of lever 52 and the related pressing member 58.

Particularly advantageous is the possibility of avoiding the use of a wire stop ferrule which would cause a lengthening of the machine tooling times and reduce the room in the tool-holder space of the same, complicating the adjustment or setting of the other components.

The invention, as described hereabove and claimed hereafter, has been proposed by way of non-limiting and non critical example, the same being susceptible of changes and variants, which fall anyhow within the scope of the novel concept.

What is claimed is:

1. A device for moving wire on machine tools, especially applicable to forging machines for producing bolts and screws, and which is driven by a rotation shaft (10) of the machine tool, said device comprising:

a) a carriage (28) having an alternating axial movement for moving said wire;

b) a pliers (30) mounted on said carriage (28) having a front arm (32) and a back arm (34) articulated with one another on a pin (36), said back arm (34) operatively communicating with a lever (42) actuated by a first cam (46) driven by said rotation shaft (10), said front arm (32) being adapted to engage said wire by the action of said first cam (46) followed by said lever (42) and said back arm (34) during the forward movement of said carriage (28); and c) a blocking means (52) adapted to engage said wire during the rearward movement of said carriage (28), said blocking means (52) including a first arm (54) actuated by a second cam (48) driven by said rotation shaft (10), a second arm (56) operatively communicating with said first arm (54) through a pin (60) longitudinally extending through said second arm (56), and a pressing member (58) which engages said wire by the action of said second cam (48) followed by said first arm (54) and said second arm (56) during the rearward movement of said carriage (28).

2. The device for moving wire on machine tools as defined in claim 1, wherein said carriage (28) is adapted to slide along rails (28') provided on a bearing casing of said carriage (28), said carriage (28) being moved by a lever (16) actuated by a rod (14) engaged with an eccentric (12) connected to said rotation shaft (10).

3. The device for moving wire on machine tools as defined in claim 1, wherein said pin (60) is supported by at least one fixed bushing (60').

4. The device for moving wire on machine tools as defined in claim 2, wherein an adjustment screw (18) is associated with eccentric (12), said adjustment screw (18) extends longitudinally in said rotation shaft (10) and is connected to an electric motor (20) controlled by a programmable logic controller.

5. The device for moving wire on machine tools as defined in claim 1, wherein said rotation shaft (10) is provided with a crown having peripheral teeth (10') driven by the machine so as to rotate rotation shaft (10).

6. The device for moving wire on machine tools as defined in claim 1, wherein said back arm (34) of pliers (30) is provided with a small roller (38) which engages with a plane (40) of lever (42).

* * * * *